United States Patent [19]

Nouel

[11] 4,410,620

[45] Oct. 18, 1983

[54] OFFSET PLATES IN STEEL, USING SURFACES CONTAINING CHROMIUM OXIDE

[76] Inventor: Jean-Marie Nouel, 67 rue de Miromesnil, Paris, France, 75008

[21] Appl. No.: 253,040

[22] Filed: Apr. 10, 1981

[30] Foreign Application Priority Data

Apr. 16, 1980 [FR] France ..... 80 08538

[51] Int. Cl.[3] ..... G03C 1/94

[52] U.S. Cl. ..... 430/276; 430/155; 430/166; 428/457; 428/469

[58] Field of Search ..... 430/276, 155, 166; 428/457, 469

[56] References Cited

U.S. PATENT DOCUMENTS 2,714,066 7/1955 Jewett et al. .

2,865,750 12/1958 Trevoy ..... 430/276

2,907,273 10/1959 Geese .

FOREIGN PATENT DOCUMENTS 762992 7/1971 Belgium .

779229 5/1972 Belgium .

82759 3/1964 France .

2417795 9/1979 France .

2385818 10/1979 France .

2446187 8/1980 France .

925961 5/1963 United Kingdom .

*Primary Examiner*—Won H. Louie, Jr.

*Attorney, Agent, or Firm*—Eyre, Mann, Lucas & Just

[57] ABSTRACT

The present invention relates to new offset plates wherein the surface of the steel-containing support is coated with a thin water-accepting layer of chromium and chromium oxide.

5 Claims, No Drawings

OFFSET PLATES IN STEEL, USING SURFACES CONTAINING CHROMIUM OXIDE

The present invention relates to new offset plates in steel, using surfaces which combine a water-accepting metal with chromium oxide.

Black iron plates have already been described, particularly in connection with the production of metallic packages, such as preserving tins for example, the surface of which plates has received a very thin coating containing a water-accepting metal such as chromium or tin, combined with a chromium oxide, as described in French Pat. Nos. 1 575 515, 77/25340, 77/25886, 78/09425, 78/25140, 74/19235 and 79/21819.

Offset plates—known as bimetallic plates—have also been described and used, in which the water-accepting surface is constituted in chromium or, in some cases, tin.

Finally, it has been suggested to produce offset plates in steel in which the water-accepting surface is constituted by a thin layer—less than about 0.5μ—of dull-finished chromium deposited on a hard water-accepting material such as stainless steel, nickel-tin or chromium.

Further research works conducted in offset plates of this last type have proved that any plate with a steel support had to have, first a hard metallic coating to ensure the protection of the steel support, and second a thin superficial coating of mat chromium as described hereinabove.

The hard metallic coating is difficult to produce due to the conflicting properties that the coating must have.

It is indeed designed to protect the steel surface against rust, and also against any treatment or mechanical friction that the plate may be subjected to.

It should further have not only good water-accepting properties, but also good ink-refusing ones.

It has now been discovered, and this is the object of the present invention, that the intermediate metallic layer situated between the steel support and the superficial dull chromium layer, can advantageously be a thin layer of chromium-chromium oxide such as that described in some of the aforementioned patents, and used to produce the surfaces of preserving tins.

By thin layer of chromium-chromium oxide is meant a layer containing a considerable proportion of chromium oxide (preferably over about 5%) the thickness of which is less than 0.5μ, and preferably between 0.0016 and 0.1μ.

Such a "thin layer" of chromiumchromium oxide is clearly different from any of the layers used up to now, the thicknesses of which have always been greater than about 1 or 1.5μ.

The steel that can be used as support to produce these plates may be ordinary steel or black iron (soft steel).

Therefore any steel support can be used, provided that said support has the qualities required for the supports of offset plates, such as for example a constant thickness and a flawless and perfectly even surface.

It is however very advantageous for the said steel or black iron to be of the "killed" quality, which quality is normally obtained by adding a certain quantity of aluminium to the steel. So-called "killed" steels (or black irons) have already been described and the specific properties of these qualities have been demonstrated; it is nonetheless to be noted that the use of steels of that particular quality, within the scope of the present invention, has special advantages due to the fact that the resulting plates can be subjected to one or more heating cycles either at certain stages in the production of the plate (for example to obtain the degassing of certain deposits) or when utilizing the plate (for example to harden the insolated layers if the need arises).

Various types of chromium-metal and chromium oxide layers can be used, and amongst these:

a chromium oxide layer deposited on the support followed by a thin layer of chromium-metal;

the simultaneous deposit of chromium-metal and chromium oxide (the metal-chromium thickness being in this case relative to the quantity of chromium-metal deposited per square meter of surface coated);

the deposit of a layer of chromium oxide followed by a simultaneous layer of chromium-metal and chromium oxide.

It has been found for all these layers that after immersion tests in a copper-plating acid bath, said layers, despite their thinness, create a very good barrier against the support corroding.

With similar tests, it has been possible to check the "suppleness" of the deposit which, owing to the presence of chromium oxide, is foldable, this particular characteristic being demonstrated by folding the plate first at 40°, then 80°, and by immersing it into a copper-plating acid bath.

It is in some cases possible to deposit the layer of chromium-chromium oxide not directly on the steel but over a thin water-accepting metallic layer, such as for example a layer of nickel-tin, of speculum or of tin.

It has also been found that when using hard and not very ductile water-accepting alloys, such as for example nickel-tin, to make the thin water-accepting metallic intermediate layer, the best results were obtained either with very thin deposits, less than 0.5μ, and preferably between 0.1μ and 0.0016μ, or by using a technique consisting in strongly bending the plate during the treatment and depositing operations. For example, with the production in reels using vertical vats, the steel sheet is subjected to bendings which can exceed 120°.

Any cracks in a deposit which is not very ductile normally open and the chromium oxide forms clogs and protects the exposed steel.

The surface of a steel plate which comprises a thin layer of chromium-chromium oxide is coated with a layer of dull chromium. Said layer is preferably thin—less than 0.5μ—as indicated hereinbefore, but it could be thicker.

The plates produced in this way—which comprise a thin layer of chromium-chromium oxide and a thin layer of chromium—can advantageously undergo a treatment with known surfacing agents such as alkaline silicates, silicic acid, polyacrylic acid, an alkaline fluoride—such treatments being recommended to give aluminium surfaces improved ink-refusing properties and adhering properties for the sensitive layers. It has indeed been found that the presence of chromium oxide under a thin surface coating in chromium was inclined to make the said treatment more efficient.

The plates according to the invention are, of course, coated with a photo-sensitive printing layer.

The following examples are given to illustrate the invention.

EXAMPLE 1

A Usinor steel plate of offset quality, and of 35/100 thickness is used; after anode scouring in a bath containing soda, and rinsing, the plate is treated:

(A) in a bath containing:

30 g/l of chromium trioxide—pH 0.7
Temperature: 40° C.
Amperage: 0.5 A/dm2
the current is first switched on in anode for 2 secs., and then in cathode for 2 secs:

(B) then in a bath containing:
250 g/l of chromium trioxide
2.5 sulphuric acid
Temperature: 35° C.
Thickness of the layer deposited: 0.04μ;

(C) and after rinsing, in a third bath for the chromium oxide deposit:
30 g/l of chromium trioxide
0.08 g/l of sulphuric acid
0.4 g/l of sodium fluoride
Temperature: 45° C.
Amperage: 5 A/dm2
Duration: 2 secs.

(D) The plate is thereafter dipped into a vat for a thin layer of dull chromium metal deposit. Said plate is dried and then coated with a photo-sensitive printing layer (P.R. 12 from PACS). After drying for 3 minutes at 45° C. and for 5 mins. at 85° C., the plate is used as a positive pre-sensitized plate.

EXAMPLE 2

The procedure is the same as in Example 1, but the treatments B and C are replaced by a bath for the metal-chromium and the chromium oxide coating, composed as follows:
Chromium trioxide: 100 g/l
Sulphuric acid: 0.5 g
Hydrofluorboric acid: 1 g/l
Temperature: 55° C.
Amperage: 20 A/dm2
Duration: 4 secs.

After rinsing and drying, the plate is treated as in Example 1.

EXAMPLE 3

A "SOLCHROME" plate, made in France by the company SOLLAC of reference "ground finish" is used. Said plate is made of cold-rolled black iron (thickness 25/100), of rugosity varying between 0.45 and 0.55μ; it is coated with between 3 and 13 μg/cm2 of chromium oxide and between 0.3 and 4 μg/cm2 of chromium and is supplied under oil.

Said plate is scoured and a layer of about 0.4μ of dull chromium is deposited on one of its faces, and on the said dull chromium layer is deposited a photo-sensitive printing layer found in the trade (thickness of this last layer: about 1.8μ).

After drying at 45° C. for three minutes and at 85° C. for five minutes, the plate is insolated with a positive film.

Developing, rinsing and gumming are then conducted.

The plate is then baked for 8 minutes at 230° C.

Such a plate has permitted printing runs of over 50,000 proofs without any problems.

It is recalled that according to EURONORM, black iron is a mild steel with a low carbon content, which has undergone no tin-plating, no oiling or any other treatment; said black iron is recommended as a support for the manufacture of metallic packages such as preserving tins for example.

EXAMPLE 4

A "SOLCHROME" plate, manufactured in France by the company SOLLAC—reference shiny finish, i.e. with a rugosity between 0.20 and 0.30μ is used.

Said plate is immersed for a few seconds in an anodic bath containing caustic soda to remove the chromium plating.

When taken out of said bath, the plate is obviously free of the chromium oxide and chromium with which it had been coated and the black iron surface is exposed and perfectly clean.

After rinsing, the plate is treated as in Example 1.

EXAMPLE 5

Good offset plates have been obtained by using to start with a plate in killed steel which has received the successive coatings such as described in Example 1:

A reel in black iron (of thickness 25/100) whose surface had been coated with a layer, about 1μ thick, of speculum.

A reel in black iron (of thickness 35/100) whose surface had been coated with a layer, about 0.05μ thick, of speculum.

A plate in black iron (of thickness 25/100) whose surface had been coated with a very fine layer of Fe Sn2 (coming from an interaction between a layer of tin and the sub-jacent iron).

EXAMPLE 6

The finished plate (steel-chromium, dull chromium oxide) obtained according to Example 1 is used, and after rinsing said plate is immersed for 45 seconds in a bath of sodium silicate (3%) whose temperature is 85° C.

After drying, the plate obtained is used in negative wipe-on.

What is claimed is:

1. An offset plate comprising a steel support having a water-accepting matte surface of dull chromium which is coated with a photosensitive polymer printing layer effective after light exposure to form an ink absorbing offset printing image on said dull chromium layer and wherein between said steel support and said dull chromium layer is provided a shiny chromium-chromium oxide layer of thickness less than 0.5 micron.

2. The offset plate as claimed in claim 1, wherein the thickness of the chromium-chromium oxide layer can varies between 0.0016 and 0.1μ.

3. The offset plate as claimed in one of claims 1 or 2, wherein between the support and the chromium-chromium oxide layer there is a thin water-accepting layer chosen from the group consisting of nickel tin, speculum, tin, and phosphorus-nickel.

4. The offset plate as claimed in claim 1 or 2, wherein the support is chosen from supports in the group consisting of "killed" quality steel and black iron supports.

5. The offset plate of claim 3 wherein the support is chosen from supports in the group consisting of "killed" quality steel and black iron supports.

* * * * *